US010362405B2

(12) United States Patent
Yoshinaga

(10) Patent No.: US 10,362,405 B2
(45) Date of Patent: Jul. 23, 2019

(54) FIXED ELECTRODE AND ELECTROACOUSTIC TRANSDUCER

(71) Applicant: Yamaha Corporation, Hamamatsu-shi, Shizuoka-ken (JP)

(72) Inventor: Kenichi Yoshinaga, Hamamatsu (JP)

(73) Assignee: Yamaha Copororation, Hamamatsu-shi (JP)

( * ) Notice: Subject to any disclaimer, the term of this patent is extended or adjusted under 35 U.S.C. 154(b) by 0 days.

(21) Appl. No.: 15/519,322

(22) PCT Filed: Oct. 14, 2015

(86) PCT No.: PCT/JP2015/078988
§ 371 (c)(1),
(2) Date: Apr. 14, 2017

(87) PCT Pub. No.: WO2016/060148
PCT Pub. Date: Apr. 21, 2016

(65) Prior Publication Data

US 2017/0245061 A1 Aug. 24, 2017

(30) Foreign Application Priority Data

Oct. 16, 2014 (JP) ..... 2014-211644

(51) Int. Cl.

| | |
|---|---|
| ***H04R 25/00*** | (2006.01) |
| ***H04R 19/02*** | (2006.01) |
| ***H04R 7/04*** | (2006.01) |
| ***H04R 19/00*** | (2006.01) |
| *H04R 19/04* | (2006.01) |

(52) U.S. Cl.
CPC ..... *H04R 19/02* (2013.01); *H04R 7/04* (2013.01); *H04R 19/005* (2013.01); *H04R 19/04* (2013.01)

(58) Field of Classification Search
CPC combination set(s) only.
See application file for complete search history.

(56) References Cited

U.S. PATENT DOCUMENTS

| | | | |
|---|---|---|---|
| 4,081,626 | A | 3/1978 | Muggli et al. |
| 4,311,881 | A | 1/1982 | Reynard |
| 4,429,193 | A | 1/1984 | Busch-Vishniac et al. |
| 5,097,515 | A | 3/1992 | Baba |
| 6,393,129 | B1 | 5/2002 | Conrad et al. |

(Continued)

FOREIGN PATENT DOCUMENTS

| | | | |
|---|---|---|---|
| CN | 103959820 | A | 7/2014 |
| EP | 0 371 620 | A2 | 6/1990 |

(Continued)

OTHER PUBLICATIONS

International Search Report (PCT/ISA/210) issued in PCT Application No. PCT/JP2015/078988 dated Nov. 24, 2015 with English translation (Four (4) pages).

(Continued)

*Primary Examiner* — Amir H Etesam
(74) *Attorney, Agent, or Firm* — Crowell & Moring LLP

(57) ABSTRACT

A fixed electrode configured to face a diaphragm and forming a capacitance with the diaphragm, including a plurality of protrusions formed by plastic deformation on one surface of the fixed electrode that is to face the diaphragm, so as to protrude toward the diaphragm.

4 Claims, 4 Drawing Sheets

(56) References Cited

U.S. PATENT DOCUMENTS

| | | | | |
|---|---|---|---|---|
| 2004/0113526 | A1* | 6/2004 | Kirjavainen | B06B 1/0261 310/328 |
| 2006/0265861 | A1 | 11/2006 | Akino | |
| 2008/0013761 | A1 | 1/2008 | Matsuzawa et al. | |
| 2008/0279498 | A1 | 11/2008 | Sampsell et al. | |
| 2008/0292888 | A1* | 11/2008 | Hucker | B81C 1/00103 428/428 |
| 2010/0065930 | A1* | 3/2010 | Nakatani | B81C 1/00476 257/415 |
| 2010/0182675 | A1 | 7/2010 | Sampsell et al. | |
| 2013/0003160 | A1 | 1/2013 | Sampsell et al. | |
| 2014/0321676 | A1 | 10/2014 | Hosoe | |
| 2015/0031160 | A1* | 1/2015 | Wang | H04R 31/00 438/53 |
| 2015/0110309 | A1* | 4/2015 | Park | H04R 19/005 381/190 |
| 2015/0154488 | A1* | 6/2015 | Heo | G06K 19/07786 235/488 |
| 2016/0112807 | A1* | 4/2016 | Yuan | H04R 19/04 381/174 |

FOREIGN PATENT DOCUMENTS

| | | | |
|---|---|---|---|
| JP | 53-62519 | A | 6/1978 |
| JP | 56-10799 | A | 2/1981 |
| JP | 2002-367873 | A | 12/2002 |
| JP | 2006-332930 | A | 12/2006 |
| JP | 2007-104371 | A | 4/2007 |
| JP | 2008-99212 | A | 4/2008 |
| JP | 2010-176141 | A | 8/2010 |
| JP | 4527282 | B2 | 8/2010 |
| JP | 2011-77663 | A | 4/2011 |
| JP | 2012-23559 | A | 2/2012 |
| JP | 5343053 | B2 | 11/2013 |
| JP | 2016-82376 | A | 5/2016 |
| WO | WO 99/56498 | A1 | 11/1999 |
| WO | WO 2013/081079 | A1 | 6/2013 |

OTHER PUBLICATIONS

Japanese-language Written Opinion (PCT/ISA/237) issued in PCT Application No. PCT/JP2015/078988 dated Nov. 24, 2015 with English translation (Thirteen (13) pages).

Extended European Search Report issued in counterpart European Application No. 15851064.4 dated Apr. 30, 2018 (10 pages).

Japanese-language Office Action issued in counterpart Japanese Application No. 2014-211644 dated Oct. 30, 2018 with English translation (seven (7) pages).

English-language translation of Chinese Office Action issued in counterpart Chinese Application No. 201580056029.4 dated Mar. 5, 2019 (nine (9) pages).

* cited by examiner

FIXED ELECTRODE AND ELECTROACOUSTIC TRANSDUCER

TECHNICAL FIELD

The present invention relates to an electrostatic electroacoustic transducer and a fixed electrode included in the electroacoustic transducer.

BACKGROUND ART

The following Patent Literature 1 discloses that a spacer is interposed between a diaphragm and an electrode facing the diaphragm, for providing a space between the electrode and the diaphragm. The following Patent Literature 2 discloses that nonwoven fabric is interposed between a diaphragm and an electrode facing the diaphragm, so that the diaphragm is spaced apart from the electrode.

CITATION LIST

Patent Literature

Patent Literature 1: JP-A-2011-077663
Patent Literature 2: JP-A-2012-023559

SUMMARY OF THE INVENTION

Technical Problem

According to the techniques disclosed in the Patent Literatures 1, 2, the diaphragm is spaced apart from the electrode, and the diaphragm is vibrated between the electrodes which are opposed to each other with the diaphragm interposed therebetween. The disclosed techniques, however, require a step of producing the spacer and the nonwoven fabric separately from the diaphragm and the electrodes and a step of mounting the separately produced members between the diaphragm and the electrodes.

The present invention has been developed in view of the situations described above. It is therefore an object to offer a technique of providing a space in which the diaphragm vibrates without interposing any member between a fixed electrode and a diaphragm in an electrostatic electroacoustic transducer.

Solution to Problem

The present invention provides a fixed electrode configured to face a diaphragm and forming a capacitance with the diaphragm, including a plurality of protrusions formed by plastic deformation on one surface of the fixed electrode that is to face the diaphragm, so as to protrude toward the diaphragm.

In the fixed electrode constructed as described above, among the plurality of protrusions, the protrusions which are to contact a peripheral portion of the diaphragm may have a height different from a height of the protrusions which are to contact a central portion of the diaphragm.

The fixed electrode constructed as described above may include a plurality of protrusions which are different from the plurality of protrusions and which are formed on the other surface of the fixed electrode opposite to the one surface thereof that is to face the diaphragm, so as to protrude in a direction away from the diaphragm.

The present invention provides an electrostatic electroacoustic transducer including the fixed electrode having any of the configurations described above.

In the electrostatic electroacoustic transducer constructed as described above, each of the two fixed electrodes may include a plurality of protrusions protruding toward the diaphragm, and the two fixed electrodes may be disposed such that the protrusions of the respective two fixed electrodes are opposed to each other.

In the electrostatic electroacoustic transducer constructed as described above, the two fixed electrodes may be constituted by a first fixed electrode and a second fixed electrode. The protrusions of the first fixed electrode may be in contact with a first surface of the diaphragm which faces the first fixed electrode, and the protrusions of the second fixed electrode may be in contact with a second surface of the diaphragm which faces the second fixed electrode and which is opposite to the first surface.

Advantageous Effects

According to the present invention, it is possible to provide a space in which the diaphragm vibrates without interposing any member between a fixed electrode and a diaphragm in an electrostatic electroacoustic transducer.

DESCRIPTION OF THE EMBODIMENT

Embodiment

Figure 1:
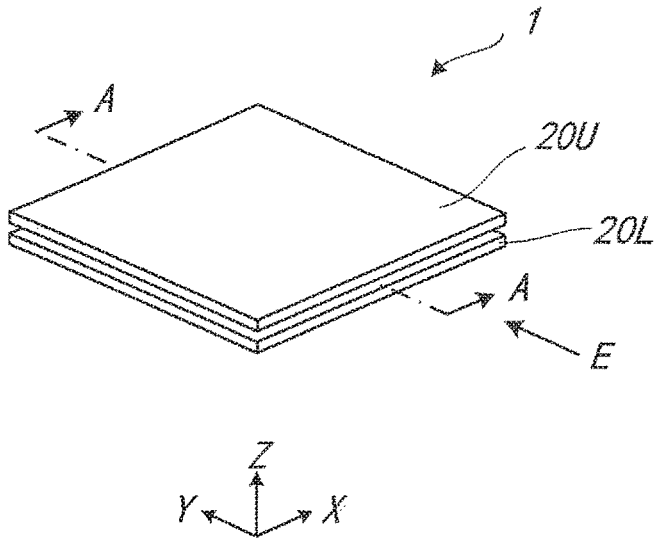
FIG. 1 is an external view of an electrostatic electroacoustic transducer 1 according to one embodiment of the present invention.
Figure 2:
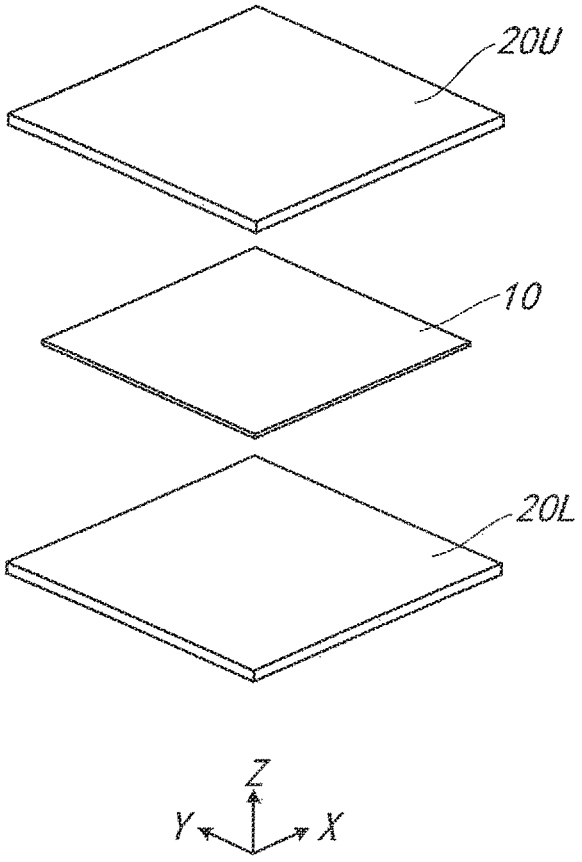
FIG. 2 is an exploded view of the electrostatic electroacoustic transducer 1.
Figure 3:
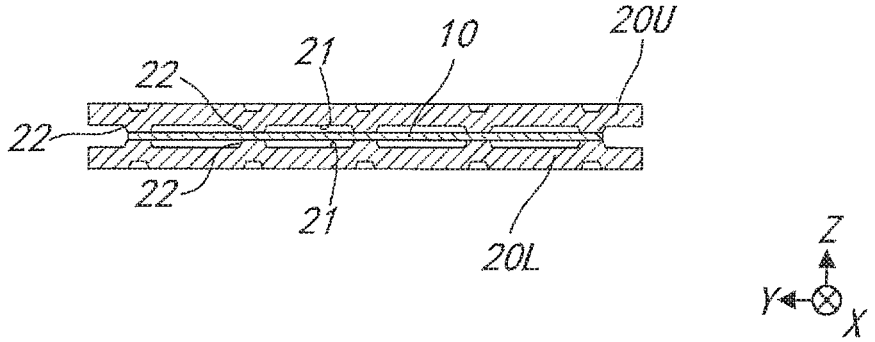
FIG. 3 is a cross-sectional view taken along line A-A in FIG. 1.
Figure 4:
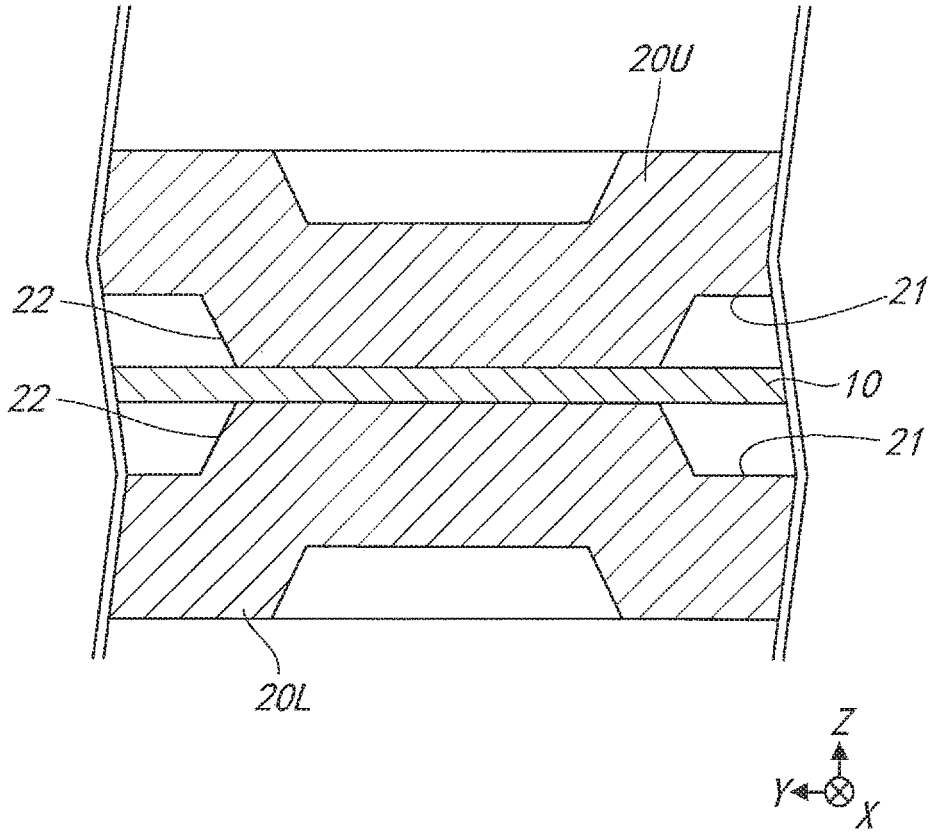
FIG. 4 is an enlarged cross-sectional view of a part of the electrostatic electroacoustic transducer 1.

FIG. 1 is an external view of an electrostatic electroacoustic transducer 1 according to one embodiment of the present invention. FIG. 2 is an exploded view of the electrostatic electroacoustic transducer 1. FIG. 3 is a cross-sectional view taken along line A-A in FIG. 1. FIG. 4 is an enlarged cross-sectional view of a part of the electrostatic electroacoustic transducer 1. In the drawings, directions are indicated by mutually perpendicular X, Y, and Z axes. The X-axis direction, the Y-axis direction, and the Z-axis direction respectively correspond to a right-left direction, a front-rear direction, and an up-down (height) direction when viewing the electrostatic electroacoustic transducer 1 from its front side toward a direction indicated by an arrow E in FIG. 1. In the drawings, "●" in "○" means an arrow directed from the back to the front of the drawing sheet, and "X" in "○" means an arrow directed from the front to the back of the drawing sheet. It is noted that dimensions of components shown in the drawings are different from actual dimensions thereof for easy understanding of shapes and positional relationships of the components.

The electrostatic electroacoustic transducer 1 includes a diaphragm 10, a fixed electrode 20U, and a fixed electrode 20L. In the present embodiment, the fixed electrode 20U and the fixed electrode 20L are identical in structure, and "L" and "U" attached to the reference number are omitted unless it is necessary to distinguish the fixed electrode 20U and the fixed electrode 20L from each other.

The diaphragm 10, which has a rectangular shape as viewed from the top, is constituted by: a film (insulating layer), as a base, formed of synthetic resin such as polyethylene terephthalate (PET) or polypropylene (PP) having insulating properties and flexibility; and a conductive membrane (conductive layer) formed by evaporating conductive metal on one surface of the film.

The fixed electrode 20 is constituted by: a sheet (insulating layer) formed of synthetic resin such as PET or PP having plasticity and insulating properties; and a conductive membrane (conductive layer) formed by evaporating conductive metal on one surface of the sheet. The fixed electrode 20 has a rectangular shape as viewed from the top. In the fixed electrode 20U, the insulating layer is located on its underside. In the fixed electrode 20L, the insulating layer is located on its topside. The fixed electrode 20 has a plurality of through-holes extending therethrough from the front surface to the back surface, thereby allowing air and sound waves to pass therethrough. The fixed electrode 20 has, on one surface thereof on which the insulating layer facing the diaphragm 10 is formed, a flat portion 21 and a plurality of protrusions 22 which are continuous to the flat portion 21 and which protrude toward the diaphragm 10. In FIGS. 1 and 2, the through-holes and the protrusions 22 are not illustrated.

Figure 5:
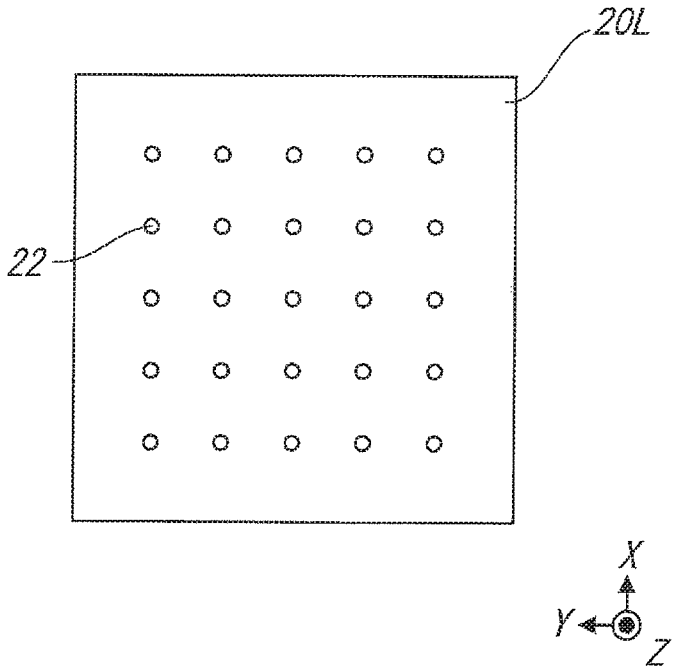
FIG. 5 is a view showing one example of a layout of protrusions.

In the present embodiment, the protrusions 22 each having a truncated conical shape are formed by embossing. In the fixed electrode 20L, the protrusions 22 are formed so as to be spaced apart from each other by a suitable distance in the right-left direction and the front-rear direction, as shown in FIG. 5. While not shown, like the fixed electrode 20L, the fixed electrode 20U has, on one surface thereof on which the insulating layer is formed, the protrusions 22 which are spaced apart from each other by a suitable distance in the right-left direction and the front-rear direction and which are located so as to be opposed to the protrusions 22 of the fixed electrode 20L. In FIG. 5, the through-holes penetrating the fixed electrode 20L from the front surface to the back surface are not illustrated.

As shown in FIGS. 3 and 4, the fixed electrode 20U has recesses in its upper surface, and the fixed electrode 20L has recesses in its lower surface. The recesses result from a metal mold used in embossing. In this respect, one-side embossing may be performed to permit the entire upper surface of the fixed electrode 20U and the entire lower surface of the fixed electrode 20L to be flat. It is preferable that the plurality of protrusions 22 have mutually the same dimension (height) in the up-down direction from the flat portion 21 to distal ends thereof. The height of the protrusions 22 from the flat portion 21 to the distal ends thereof need not be mutually the same as long as the height of the protrusions 22 falls within a predetermined tolerance.

In fixing the diaphragm 10 and the fixed electrode 20, an adhesive is first applied to the distal ends of the protrusions 22. Subsequently, the diaphragm 10 is sandwiched between the fixed electrode 20U and the fixed electrode 20L such that the distal ends of the protrusions 22 of the fixed electrode 20U and the distal ends of the protrusions 22 of the fixed electrode 20L are opposed to one another, namely, such that positions of the protrusions 22 of the fixed electrode 20U in the X axis and the Y axis (i.e., coordinates) and positions of the protrusions 22 of the fixed electrode 20L in the X axis and the Y axis (i.e., coordinates) coincide with one another. Thereafter, a pressure is applied, from above, to the sandwiched structure of the fixed electrodes 20U, 20L and the diaphragm 10 placed on a surface plate. The protrusions 22 have mutually the same height in the up-down direction from the flat portion 21 to the distal ends thereof. Consequently, a distance between the diaphragm 10 and the fixed electrode 20U after fixation is equal to the height of the protrusions 22 from the flat portion 21 to the distal ends thereof in the up-down direction. Likewise, a distance between the diaphragm 10 and the fixed electrode 20L is equal to the height of the protrusions 22 from the flat portion 21 to the distal ends thereof in the up-down direction. Portions of the diaphragm 10 which are not in contact with the protrusions 22 are disposed between the fixed electrode 20U and the fixed electrode 20L with air layers interposed therebetween and are capable of vibrating in the up-down direction.

Figure 6:
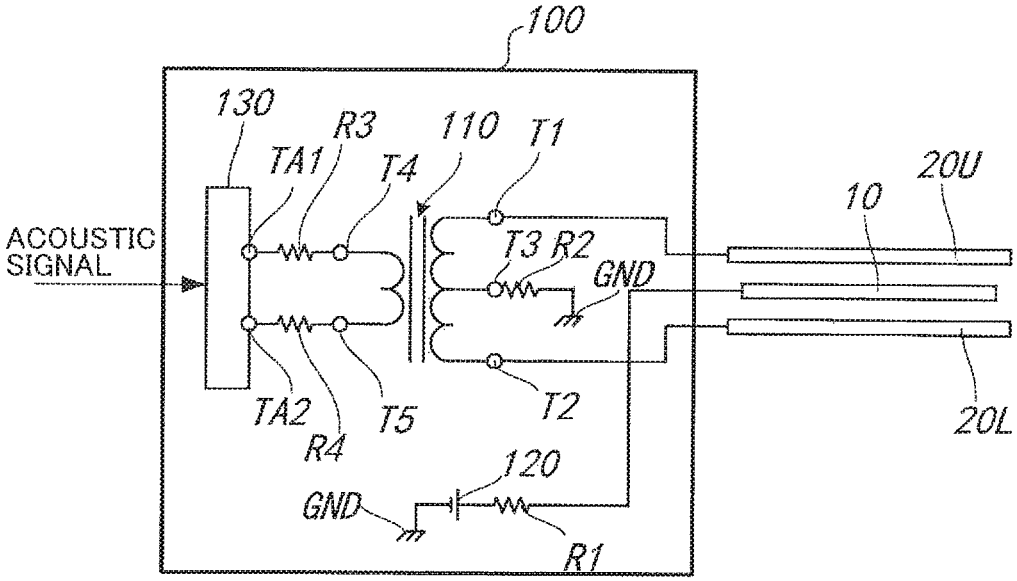
FIG. 6 is a view showing an electrical configuration of the electrostatic electroacoustic transducer 1.

There will be next explained an electrical configuration of the electrostatic electroacoustic transducer 1. As shown in FIG. 6, a drive circuit 100 is connected to the electrostatic electroacoustic transducer 1. The drive circuit 100 includes an amplifier 130 to which are input acoustic signals representing sounds, a transformer 110, and a bias supply 120 for supplying a DC bias to the diaphragm 10.

The fixed electrode 20U is connected to one secondary-side terminal T1 of the transformer 110 while the fixed electrode 20L is connected to the other secondary-side terminal T2 of the transformer 110. The diaphragm 10 is connected to the bias supply 120 via a resistor R1. A midpoint terminal T3 of the transformer 110 is connected, via a resistor R2, to the ground GND having a reference potential of the drive circuit 100.

An acoustic signal is input to the amplifier 130. The amplifier 130 amplifies the input acoustic signal and outputs the amplified acoustic signal. The amplifier 130 includes terminals TA1, TA2 for outputting the acoustic signal. The terminal TA1 is connected to one primary-side terminal T4 of the transformer 110 via a resistor R3, and the terminal TA2 is connected to the other primary-side terminal T5 of the transformer 110 via a resistor R4.

When an AC acoustic signal is input to the amplifier 130, the input acoustic signal is amplified and is supplied to the primary side of the transformer 110. When the acoustic signal boosted by the transformer 110 is supplied to the fixed electrode 20 and there is generated a potential difference between the fixed electrode 20U and the fixed electrode 20L, the diaphragm 10 disposed between the fixed electrode 20U and the fixed electrode 20L is subjected to electrostatic force that acts thereon such that the diaphragm 10 is attracted toward one of the fixed electrode 20U and the fixed electrode 20L.

Specifically, the polarity of a second acoustic signal output from the terminal T2 is opposite to the polarity of a first acoustic signal output from the terminal T1. When an acoustic signal whose polarity is plus is output from the terminal T1 and an acoustic signal whose polarity is minus is output from the terminal T2, a plus voltage is applied to the fixed electrode 20U while a minus voltage is applied to the fixed electrode 20L. Because a plus voltage has been applied to the diaphragm 10 by the bias supply 120, electrostatic attraction force between the diaphragm 10 and the fixed electrode 20U to which the plus voltage is applied is weakened whereas electrostatic attraction force between the diaphragm 10 and the fixed electrode 20L to which the minus voltage is applied is strengthened. As a result, there acts, on the diaphragm 10, force to be attracted toward the fixed electrode 20L in accordance with a difference between the electrostatic attraction forces applied to the diaphragm 10, so that portions of the diaphragm 10 which are not in contact with the protrusions 22 are displaced toward the fixed electrode 20L, namely, downward.

When the first acoustic signal whose polarity is minus is output from the terminal T1 and the second acoustic signal whose polarity is plus is output from the terminal T2, a minus voltage is applied to the fixed electrode 20U while a plus voltage is applied to the fixed electrode 20L. Because a plus voltage has been applied to the diaphragm 10 by the bias supply 120, electrostatic attraction force between the diaphragm 10 and the fixed electrode 20L to which the plus voltage is applied is weakened whereas electrostatic attraction force between the diaphragm 10 and the fixed electrode 20U to which the minus voltage is applied is strengthened. As a result, there acts, on the diaphragm 10, force to be attracted toward the fixed electrode 20U in accordance with a difference between the electrostatic attraction forces applied to the diaphragm 10, so that portions of the diaphragm 10 which are not in contact with the protrusions 22 are displaced toward the fixed electrode 20U, namely, upward.

Thus, the diaphragm 10 is displaced (deflected) upward or downward depending upon the acoustic signal. The direction of the displacement changes sequentially so as to generate vibration, and sound waves corresponding to the vibration state (such as the frequency, the amplitude, and the phase) are generated from the diaphragm 10. The generated sound waves pass through the fixed electrode 20 having acoustic transmission property and are emitted to an outside of the electrostatic electroacoustic transducer 1 as sounds.

In the present embodiment, the distance between the flat portion 21 of the fixed electrode 20 and the diaphragm 10 is kept equal to the height of the protrusions 22 from the flat portion 21 to the distal ends of the protrusions 22 owing to provision of the protrusions 22, so as to avoid or reduce a variation in the distance between the fixed electrode 20 and the diaphragm 10.

In the present embodiment, the diaphragm 10 is supported so as to be spaced apart from the fixed electrode 20 without providing the spacer or the nonwoven fabric between the fixed electrode 20 and the diaphragm 10. This configuration reduces required components of the electrostatic electroacoustic transducer 1, resulting in a reduced cost and steps for production of the electrostatic electroacoustic transducer 1.

In the present embodiment, the protrusions 22 are formed by embossing. By changing the metal mold used in embossing, the height of the protrusions 22 in the up-down direction, the number of the protrusions 22, and the layout of the protrusions 22 are easily changed.

Modifications

While there has been described above one embodiment of the present invention, it is to be understood that the present invention is not limited to the details of the embodiment but may be embodied otherwise. For instance, the illustrated embodiment may be modified as follows so as to practice the invention. It is noted that the illustrated embodiment and the following modifications may be suitably combined.

In the embodiment illustrated above, the fixed electrode 20 is formed by evaporating metal on the synthetic resin sheet. The fixed electrode 20 may be formed as follows. A conductive metal film is sandwiched between synthetic resin sheets having plasticity and insulating properties, and there are formed: a plurality of holes penetrating through the sandwiched structure from its front surface to its back surface; and a plurality of protrusions 22 protruding toward the diaphragm 10. Alternatively, the fixed electrode 20 may be formed as follows. A conductive metal film is sandwiched between paper, and there are formed: a plurality of holes penetrating through the sandwiched structure from its front surface to its back surface; and a plurality of protrusions 22 protruding toward the diaphragm 10.

In the embodiment illustrated above, the protrusions 22 have mutually the same height from the flat portion 21 to the distal ends thereof. This is not essential. The height of the protrusions 22 may be made different depending on the position.

For instance, the height in the up-down direction of the protrusions 22 contacting the diaphragm 10 may be decreased in a direction from the peripheral portion toward the central portion of the diaphragm 10. With this configuration, the distance between the diaphragm 10 and the fixed electrode 20 is larger at the peripheral portion of the diaphragm 10, and the amplitude at the peripheral portion of the diaphragm 10 is smaller than that at the central portion of the diaphragm 10. Consequently, the sound pressure of the sound emitted from the peripheral portion is lower than that of the sound emitted from the central portion, so as to reduce a side lobe in directivity characteristics.

While the protrusions 22 are formed by embossing in the embodiment illustrated above, the protrusions 22 may be formed otherwise. For instance, the fixed electrode 20 may be plastically deformed by other forming methods such as vacuum forming so as to form the protrusions 22.

In the embodiment illustrated above, the distal ends of the protrusions 22 have mutually the same area. The area of the distal ends of the protrusions 22 may be made different among the protrusions 22 depending on the position thereof.

In the embodiment illustrated above, the protrusions 22 are formed in a plurality of columns and rows in the front-rear and right-left directions such that a distance between two protrusions 22 adjacent to each other in the front-rear direction and a distance between two protrusions 22 adjacent to each other in the right-left direction are equal. The distance between adjacent two protrusions 22 may differ depending on the position or the direction.

In the embodiment illustrated above, the protrusions 22 have a truncated conical shape. The protrusions 22 may have other shape such as a truncated pyramid. The protrusions 22 may have a linear shape or a lattice shape when viewed in the up-down direction.

In the embodiment illustrated above, the fixed electrode 20 has the protrusions 22 provided on one surface thereof facing the diaphragm 10. The fixed electrode 20 may further have protrusions on the other surface opposite to the one surface facing the diaphragm 10.

Figure 7A:
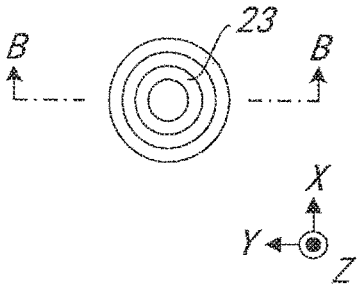
FIGS. 7A and 7B are views each for explaining protrusions according to a modification.
Figure 7B:
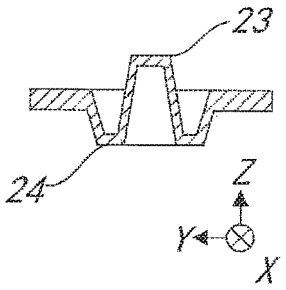

FIGS. 7A and 7B are enlarged views of one of protrusions according to a modification of the present invention. FIG. 7A is a view of the protrusion provided for the fixed electrode 20 as viewed from above, and FIG. 7B is a cross-sectional view taken along line B-B in FIG. 7A.

In this modification, the fixed electrode 20 includes protrusions 23 protruding from one surface of the fixed electrode 20 and protrusions 24 protruding from the other surface of the fixed electrode 20. The protrusion 23 has a truncated conical shape, and the protrusion 24 has an annular shape. The protrusion 23 and the protrusion 24 has a common center axis.

Figure 8A:
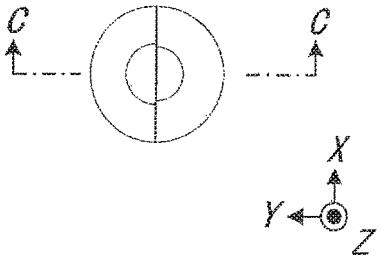
FIGS. 8A and 8B are views each for explaining protrusions according to another modification.
Figure 8B:
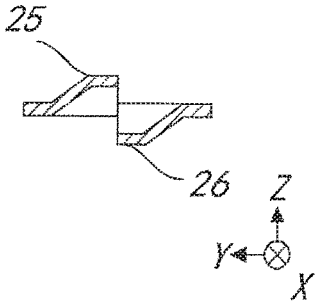

FIGS. 8A and 8B are enlarged views of one of protrusions according to another modification of the present invention. FIG. 8A is a view of the protrusion provided for the fixed electrode 20 as viewed from above, and FIG. 8B is a cross-sectional view taken along line C-C in FIG. 8A. In this modification, the fixed electrode 20 includes protrusions 25 protruding from one surface of the fixed electrode 20 and protrusions 26 protruding from the other surface of the fixed electrode 20. Each of the protrusion 25 and the protrusion 26 has a shape obtained by dividing a truncated cone into halves along the up-down direction.

Figure 9A:
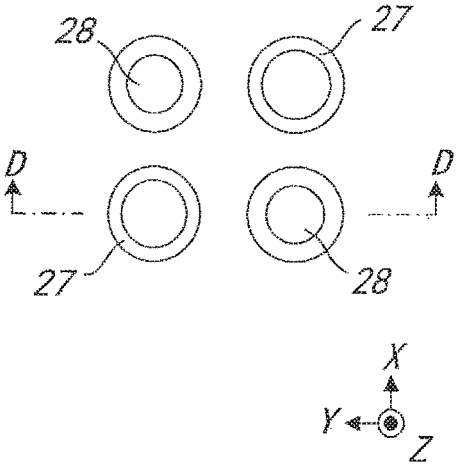
FIGS. 9A and 9B are views each for explaining protrusions according to still another modification.
Figure 9B:
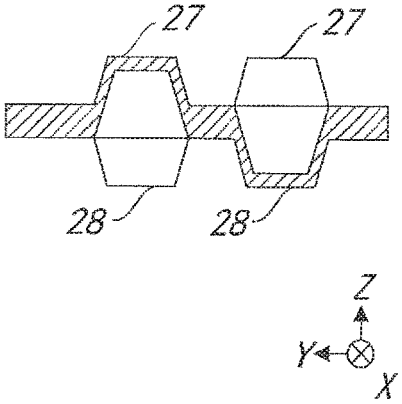

FIGS. 9A and 9B are enlarged views of protrusions according to still another modification of the present invention. FIG. 9A is a view of the protrusions provided for the fixed electrode 20 as viewed from above, and FIG. 9B is a cross-sectional view taken along line D-D in FIG. 9A. In this modification, the fixed electrode includes protrusions 27 protruding from one surface of the fixed electrode 20 and protrusions 28 protruding from the other surface of the fixed electrode 20. The protrusions 27 and the protrusions 28 have the same truncated conical shape and are formed so as to be opposite or inverted relative to each other in the up-down direction. In this modification, the protrusions 28 are provided on the other surface of the fixed electrode 20 opposite to the one surface thereof on which the protrusions 27 are provided, such that each protrusion 28 is located at a position spaced apart from each protrusion 27 by a predetermined distance in the right-left direction and the front-rear direction. The layout of the protrusions 27 and the protrusions 28 may be freely determined. For instance, the protrusions 27 and the protrusions 28 may be alternately disposed in the right-left direction and the front-rear direction. The protrusions 27 and the protrusions 28 may be disposed otherwise. In short, it is essential that the fixed electrode 20 include the protrusions on its opposite surfaces in the up-down direction, namely, on both of the upper surface and the lower surface.

In the arrangements shown in FIGS. 7-9 in which the fixed electrode 20 includes the protrusions on its upper and lower surfaces, in an instance where a poster or the like is bonded to the upper surface of the fixed electrode 20U or the lower surface of the fixed electrode 20L with an adhesive applied to the distal ends of the protrusions, the poster is fixed at its plurality of portions to the protrusions. It is thus possible to prevent or reduce vibration of the poster when the sound is emitted.

A case is considered in which the fixed electrode 20 including the protrusions on its opposite surfaces shown in FIGS. 7-9 is employed in an arrangement disclosed in JP-A-2012-080531 in which the diaphragm is disposed on both of the upper side and the lower side of one fixed electrode, namely, an arrangement including a plurality of diaphragms. In this case, the spacing between each diaphragm and the fixed electrode can be maintained owing to the protrusions without disposing nonwoven fabric therebetween.

The electrostatic electroacoustic transducer 1 according to the embodiment illustrated above operates as a speaker configured to emit sounds. The configurations of the embodiment and the modifications may be applied to a microphone as the electroacoustic transducer. When the electrostatic electroacoustic transducer 1 of the present invention is operated as a speaker, the circuit shown in FIG. 6 is utilized. When the electrostatic electroacoustic transducer 1 is used as a microphone, the direction of the signals input to and output from the amplifier 130 in the drive circuit 100 is opposite to that when used as the speaker. When the sound waves are generated at the outside of the electrostatic electroacoustic transducer 1, the diaphragm 10 is vibrated by the sound waves that reach the electrostatic electroacoustic transducer 1. When the diaphragm 10 is vibrated, the potential of the fixed electrode 20 changes. This potential change of the fixed electrode 20 corresponds to a displacement of the diaphragm 10 by the vibration and is supplied as an acoustic signal to the transformer 110 via the terminal T1 and the terminal T2. The transformer 110 transforms the input acoustic signal and outputs the transformed acoustic signal to the amplifier 130. The amplifier 130 amplifies the acoustic signal input thereto and outputs the amplified acoustic signal to the speaker, computers, and the like (not shown).

EXPLANATION OF REFERENCE SIGNS

1: electrostatic electroacoustic transducer, 10: diaphragm, 20, 20U, 20L: fixed electrodes, 21: flat portion, 22-28: protrusions, 100: drive circuit, 110: transformer, 120: bias supply, 130: amplifier

The invention claimed is:

1. An electrostatic electroacoustic transducer, comprising:

two fixed electrodes, both of which are configured to face a diaphragm and form a capacitance with the diaphragm, including a plurality of protrusions formed by plastic deformation on one surface of both of the two fixed electrodes that faces the diaphragm, so as to protrude toward the diaphragm; and the diaphragm interposed between the two fixed electrodes which are opposed to each other;

wherein the diaphragm and the fixed electrodes are fixed to each other by an adhesive applied to distal ends of the protrusions.

2. The electrostatic electroacoustic transducer according to claim 1, wherein each of the two fixed electrodes includes a plurality of protrusions protruding toward the diaphragm, and wherein the two fixed electrodes are disposed such that the protrusions of the respective two fixed electrodes are opposed to each other.

3. The electrostatic electroacoustic transducer according to claim 2, wherein the two fixed electrodes are constituted by a first fixed electrode and a second fixed electrode, wherein the protrusions of the first fixed electrode are always in contact with a first surface of the diaphragm which faces the first fixed electrode, and wherein the protrusions of the second fixed electrode are always in contact with a second surface of the diaphragm which faces the second fixed electrode and which is opposite to the first surface.

4. The electrostatic electroacoustic transducer according to claim 1, wherein the two fixed electrodes include a conductive metal film sandwiched between paper to form a sandwiched structure; a plurality of holes penetrating through the sandwiched structure from a front surface to a back surface; and a plurality of protrusions protruding toward the diaphragm.

* * * * *